US005901872A

United States Patent [19]

Zollinhofer et al.

[11] Patent Number: 5,901,872

[45] Date of Patent: May 11, 1999

[54] TRASH CONTAINER WITH SUMP AND SIDE DOOR

[76] Inventors: Rick Zollinhofer, Rte. 1, Box 76, Grandview, Tenn. 37337; Tracy L Rudder, 5507 Hidden Oaks La., Doltewah, Tenn. 37363

[21] Appl. No.: 08/986,822

[22] Filed: Dec. 8, 1997

[51] Int. Cl.[6] ..... B65F 1/12

[52] U.S. Cl. ..... 220/573; 220/571; 220/908.1; 220/908; 220/495.11; 232/43.1

[58] Field of Search ..... 220/908, 908.1, 220/571, 573, 608, 495.06, 495.08, 495.11; 232/43.1

[56] References Cited

U.S. PATENT DOCUMENTS 1,117,544 11/1914 Barash .
1,157,008 10/1915 Lang ..... 220/908
3,063,591 11/1962 Laginestra ..... 220/908
3,964,630 6/1976 Getz ..... 220/495.08
4,809,850 3/1989 Laible et al. ..... 220/908
5,123,562 6/1992 Bullard et al. ..... 220/908
5,152,420 10/1992 Bird et al. ..... 220/908
5,174,468 12/1992 Holderman ..... 220/571
5,294,017 3/1994 Li ..... 220/908.1
5,361,978 11/1994 Monroe ..... 220/908
5,372,271 12/1994 Miller et al. ..... 220/908
5,540,351 7/1996 Luescher ..... 220/908

*Primary Examiner*—Stephen Castellano
*Attorney, Agent, or Firm*—Michael I. Kroll

[57] ABSTRACT

An improved versatile container (12) comprising a housing (14) having a base (16) and an open top end (18) to hold a plastic bag (20) therein, so that articles can be placed within the plastic bag (20) for removal. A facility (22) in the housing (14) is for allowing a person (24) removal of the plastic bag (20) through a side of the housing (14) instead of lifting the plastic bag (20) out over the open top end (18), thereby decreasing back strain to the person (24).

3 Claims, 9 Drawing Sheets

TRASH CONTAINER WITH SUMP AND SIDE DOOR

BACKGROUND OF THE INVENTION

1. Field of the Invention

The instant invention relates generally to receptacles and more specifically it relates to an improved versatile container. The improved versatile container consists of a housing having a door hinged thereto that will open, so as to allow a person removal of a plastic bag therein through a side opening in the housing, instead of lifting the plastic bag out over the top end, thereby decreasing back strain to the person.

2. Description of the Prior Art

Numerous receptacles have been provided in prior art that are adapted to hold plastic bags which when filled are difficult to be removed from the receptacles. While these units may be suitable for the particular purpose to which they address, they would not be as suitable for the purposes of the present invention as heretofore described.

SUMMARY OF THE INVENTION

A primary object of the present invention is to provide an improved versatile container that will overcome the shortcomings of the prior art devices.

Another object is to provide an improved versatile container which consists of a housing having a door hinged thereto that will open, so as to allow a person removal of a plastic bag therein through a side opening in the housing, instead of lifting the plastic bag out over the top end, thereby decreasing back strain to the person.

An additional object is to provide an improved versatile container in which the housing has a raised centered contoured base to form a liquid retention sump, to retain therein liquid leaking from the plastic bag away from the door.

A still additional object is to provide an improved versatile container having a plurality of wheels under the base of the housing to increase mobility thereto, especially under heavy loads.

A further object is to provide an improved versatile container that is simple and easy to use.

A still further object is to provide an improved versatile container that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DESCRIPTION OF THE PREFERRED EMBODIMENTS

Figure 1:
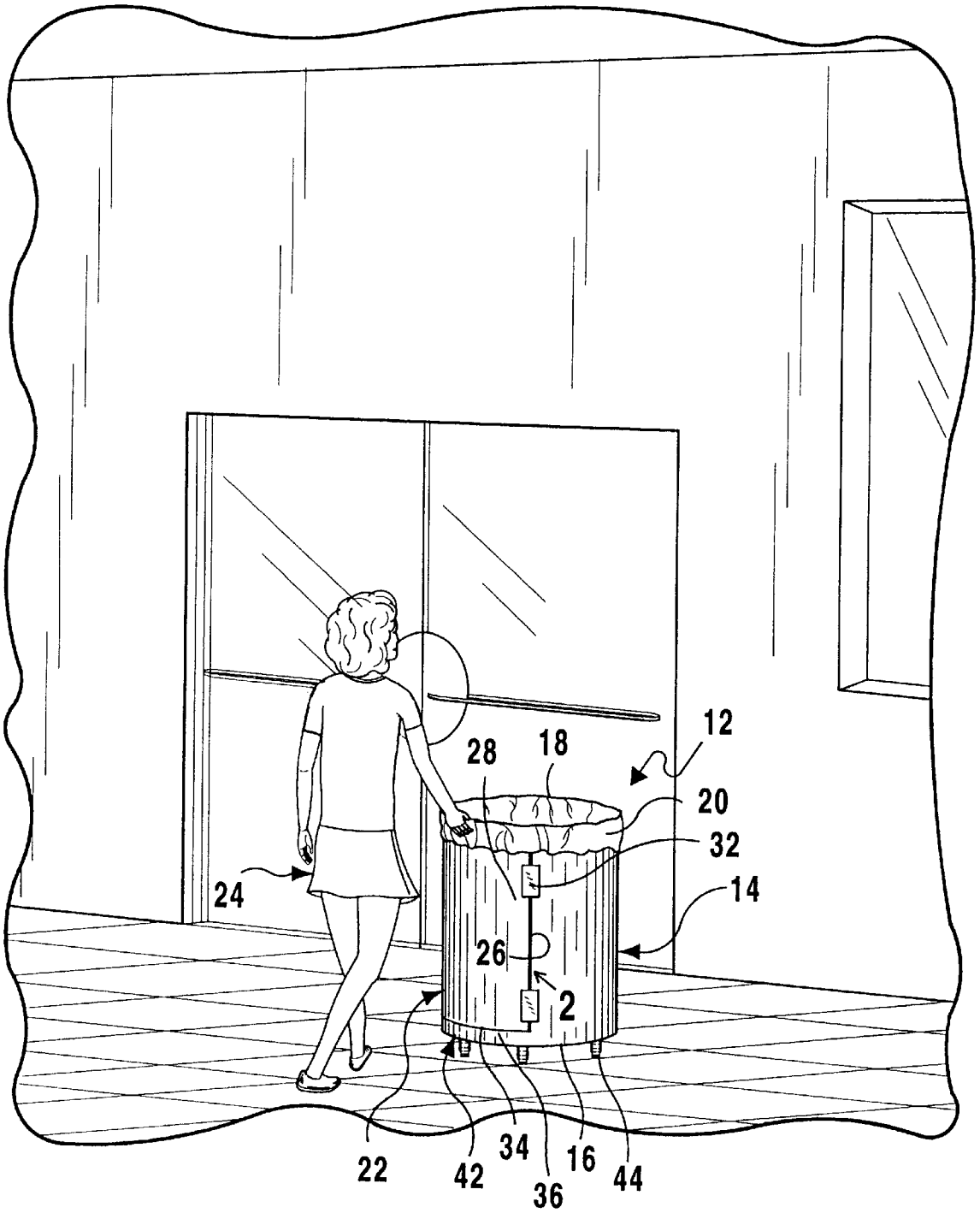
FIG. 1 is a right side perspective view of a first embodiment of the present invention with the door closed and in use.
Figure 2:
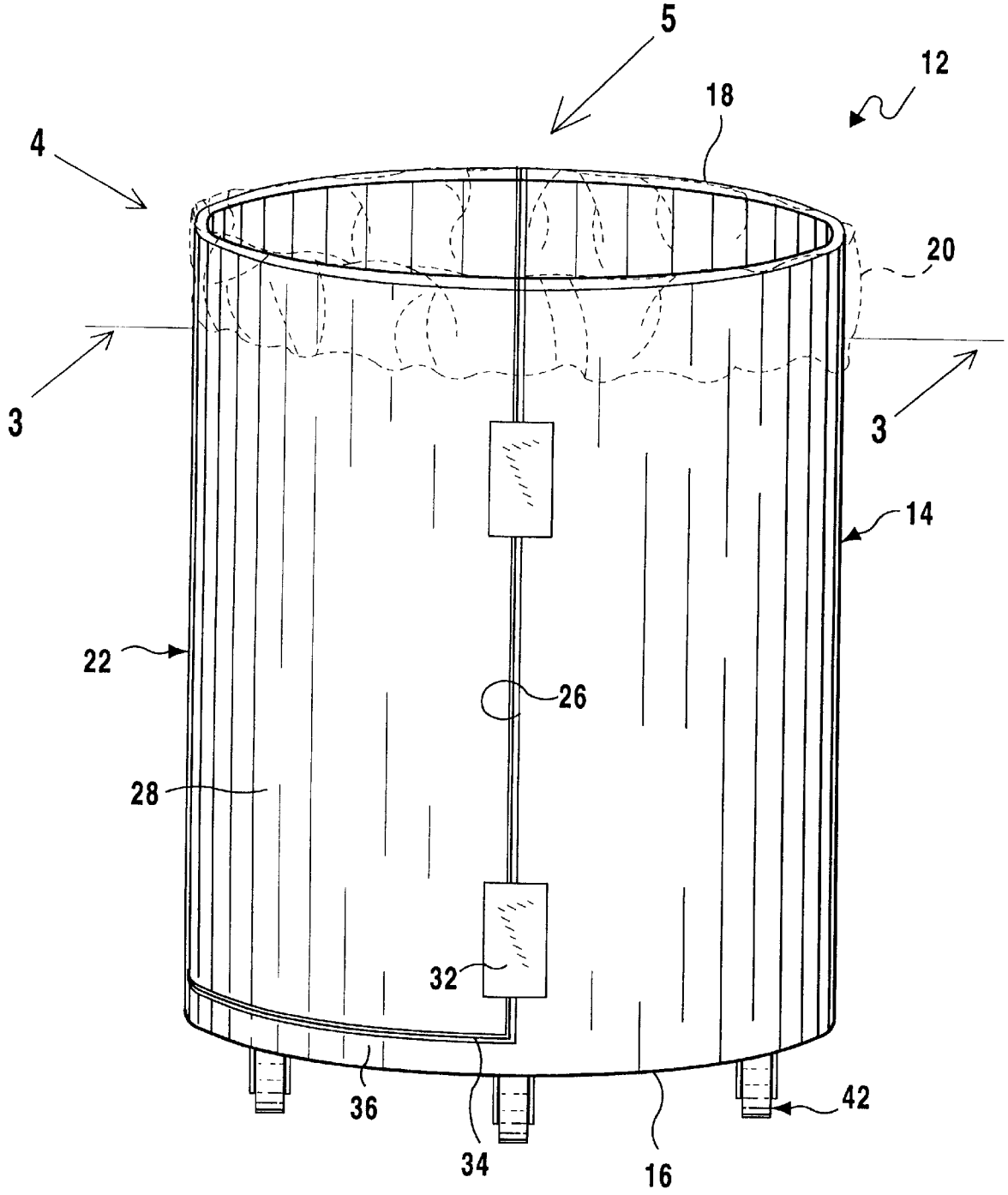
FIG. 2 is an enlarged right side perspective view as indicated by arrow 2 in FIG. 1, showing the plastic bag in phantom.
Figure 3:
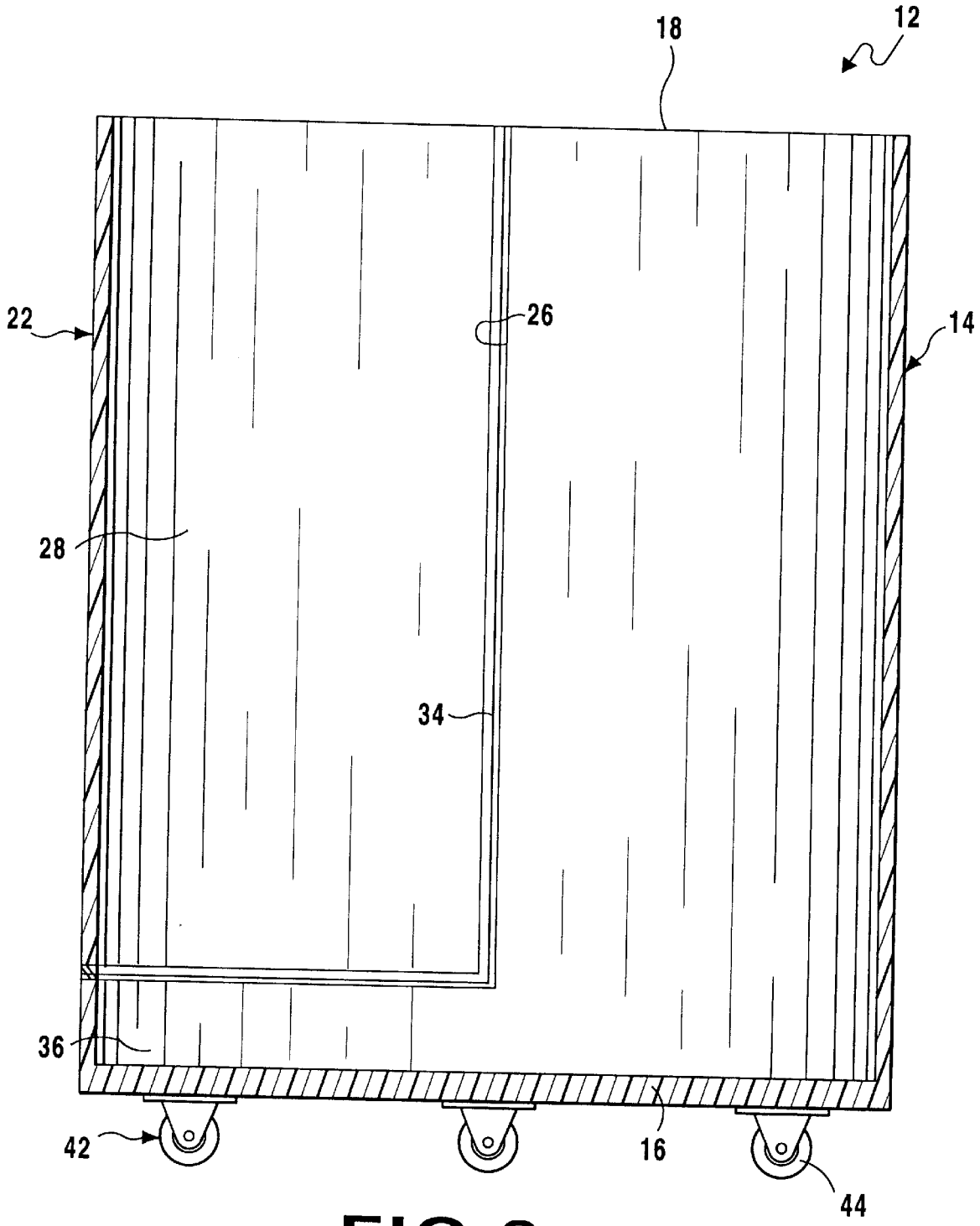
FIG. 3 is a cross sectional view taken along line 3—3 in FIG. 2, with the plastic bag removed therefrom.
Figure 4:
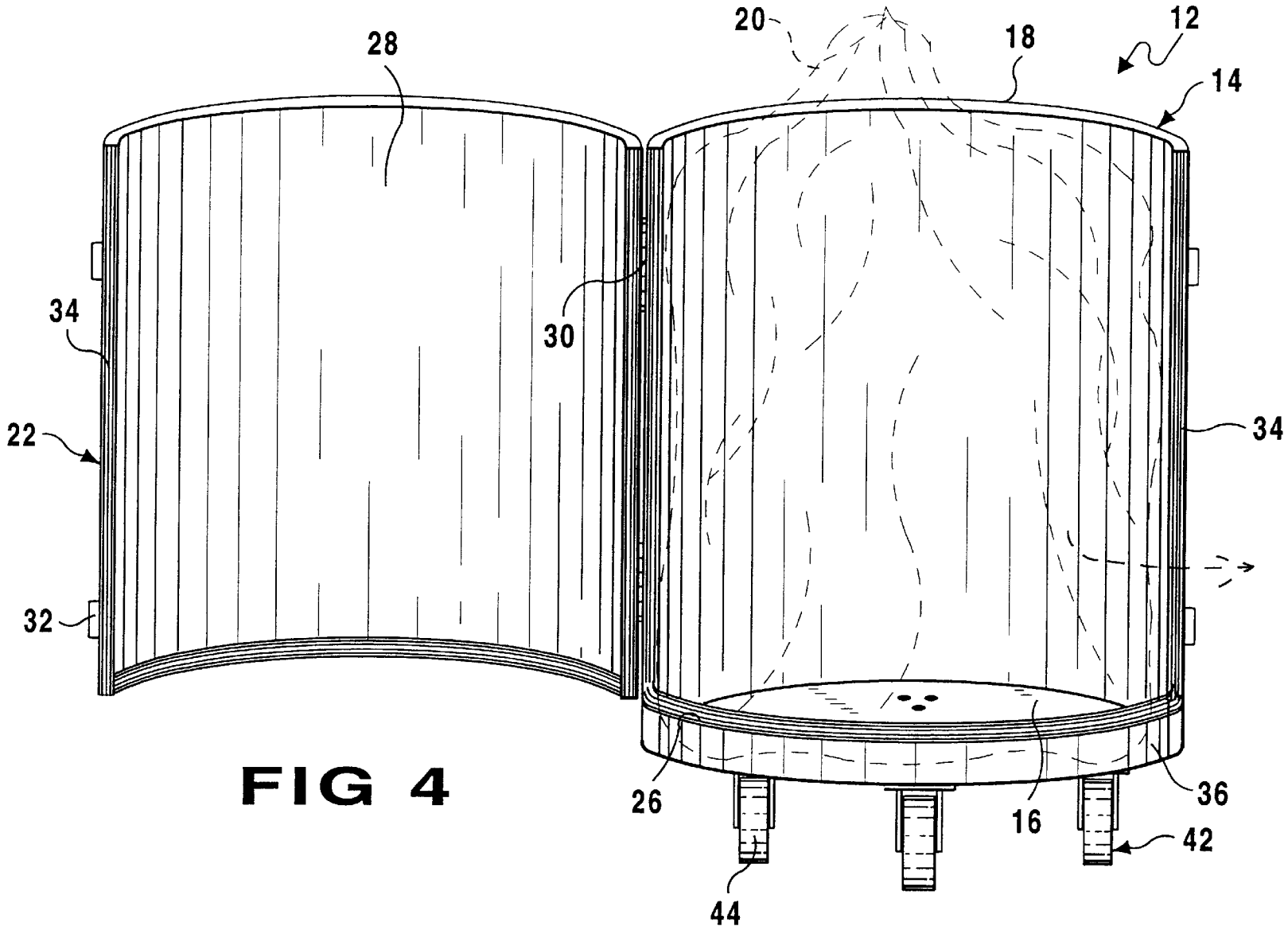
FIG. 4 is a front perspective view taken in the direction of arrow 4 in FIG. 2, showing the door opened and the plastic bag in phantom, ready to be taken out through the side opening.
Figure 5:
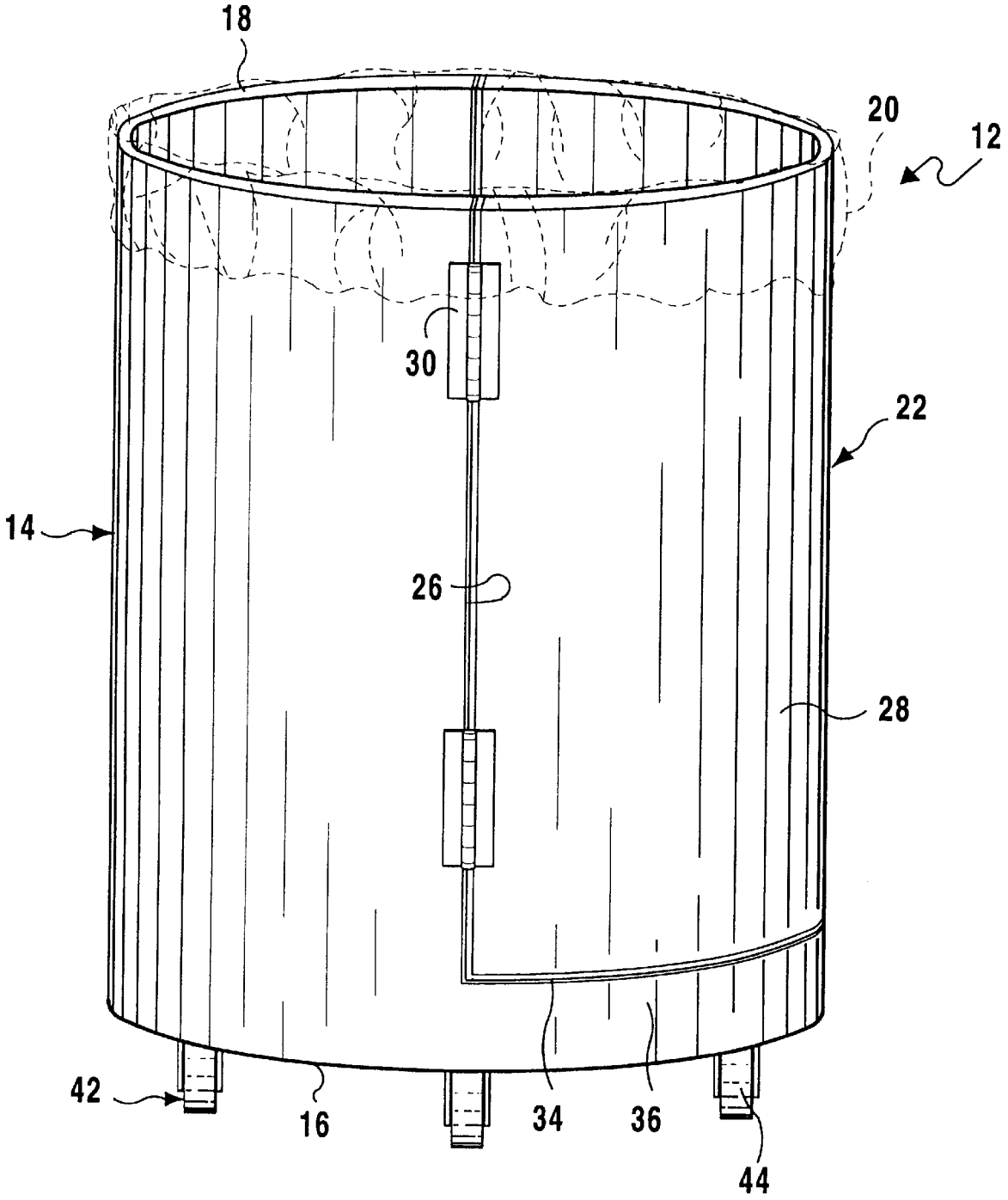
FIG. 5 is a left side perspective view taken in the direction of arrow 5 in FIG. 2.

Turning now descriptively to the drawings, in which similar reference characters denote similar elements throughout the several views, FIGS. 1 through 8 illustrate the present vention being an improved versatile container 12. With regard to the reference numerals used, the following numbering is used throughout the various drawing figures.

12 improved versatile container
14 housing of 12
16 base of 14
18 open top end of 14
20 plastic bag in 14
22 removal allowing facility of 12
24 person
26 side opening in 14 of 22
28 door of 22
30 hinge of 22 between 26 and 28
32 flip latch of 22
34 gasket seal between 26 and 28
36 upstanding lip on 14 between 16 and 26
38 raised centered contoured portion of 16
40 liquid retention sump in 14
42 mobility increasing structure of 12
44 caster of 42
46 mobility increasing assembly of 12
48 dolly for 46
50 platform of 48
52 caster of 48 under 50
54 centering member of 48 on 50

The improved versatile container 12 comprises a housing 14 having a base 16 and an open top end 18 to hold a plastic bag 20 therein, so that articles can be placed within the plastic bag 20 for removal. A facility 22 in the housing 14 is for allowing a person 24 removal of the plastic bag 20 through a side of the housing 14, instead of lifting the plastic bag 20 out over the open top end 18, thereby decreasing back strain to the person 24.

The removal allowing facility 22 includes the housing 14 having a side opening 26 extending downwardly from the open top end 18. A door 28 is hinged at 30 to the side opening 26 of the housing 14. When the door 28 is opened, the plastic bag 20 can be taken out through the side opening 26 of the housing 14. At least one flip latch 32 is to securely close the door 28 to the housing 14.

A gasket seal 34 is between the side opening 26 in the housing 14 and the door 28, so as to ensure a leakproof housing 14 when the door 28 is closed. The housing 14 has an upstanding lip 36 between the base 16 and a bottom end of the side opening 26.

The base 16 of the housing 14 is flat thereacross, as shown in FIGS. 1 through 5. The base 16 of the housing 14 has a raised centered contoured portion 38, to form a liquid retention sump 40 to retain liquid therein leaking from the plastic bag 20 away from the door 28, as shown in FIGS. 6 through 8.

A structure 42 under the base 16 of the housing 14 in FIGS. 1 through 5 is for increasing mobility to the housing 14, especially when the housing 14 is carrying a heavy load. The mobility increasing structure 42 consists of a plurality of casters 44 mounted to the underside of the base 16 of the housing 14.

Figure 6:
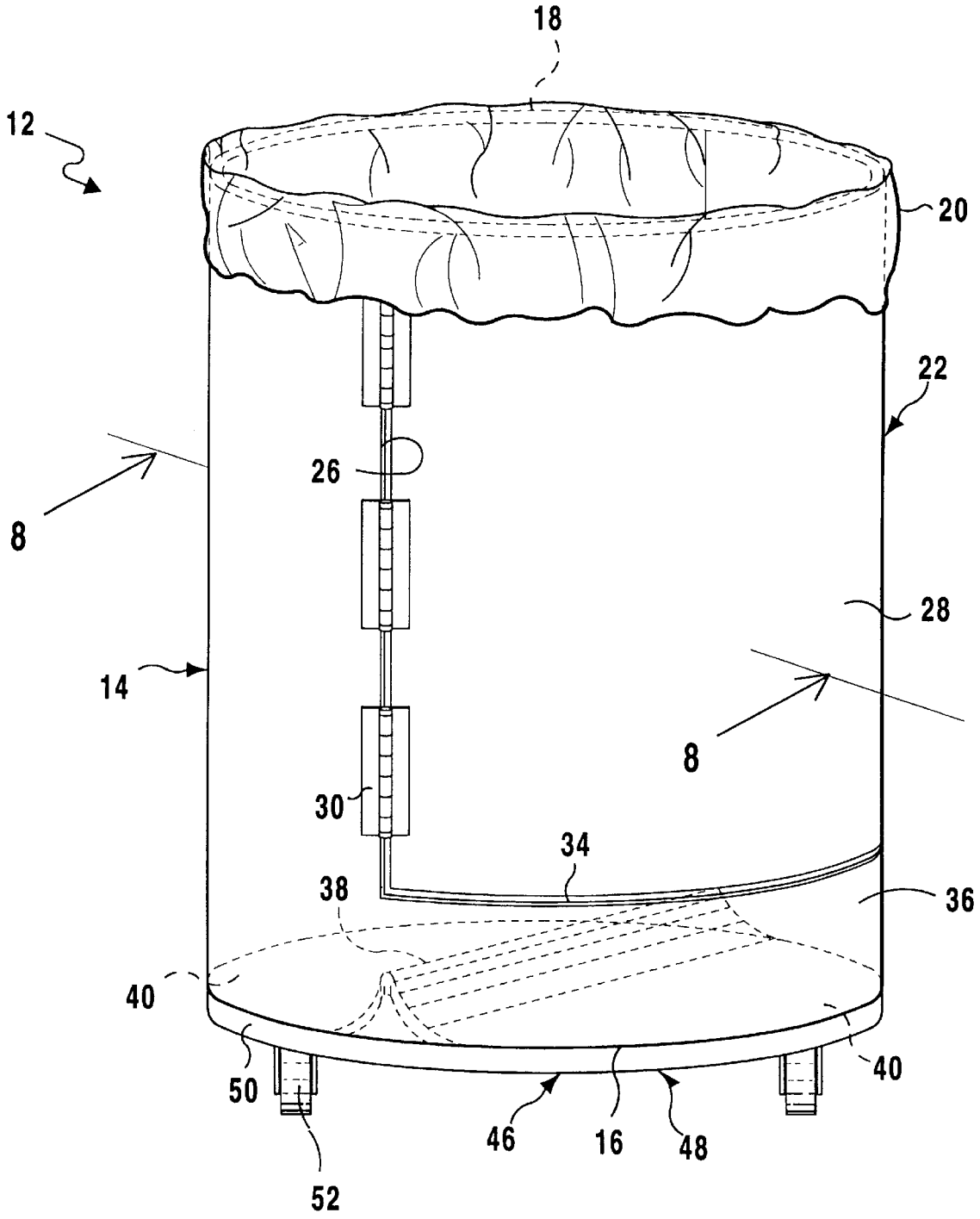
FIG. 6 is a left side view of a second embodiment of the present invention with the door closed, the plastic bag in place and showing a dolly placed under a raised centered contoured base.
Figure 7:
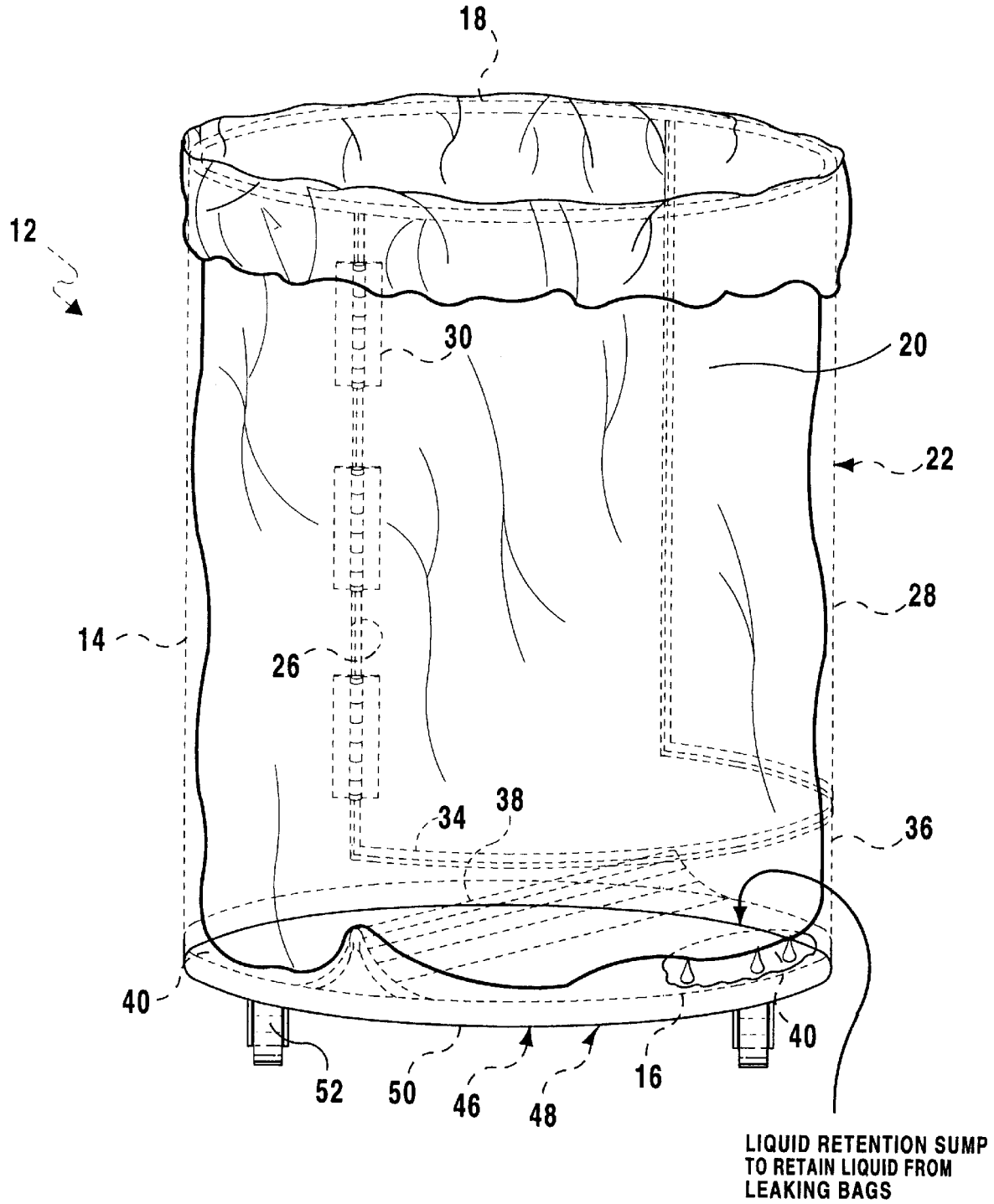
FIG. 7 is a left side view similar to FIG. 6, with the cylindrical housing in phantom, showing a liquid retention sump within the raised contoured base to retain liquid leaking from the plastic bag.
Figure 8:
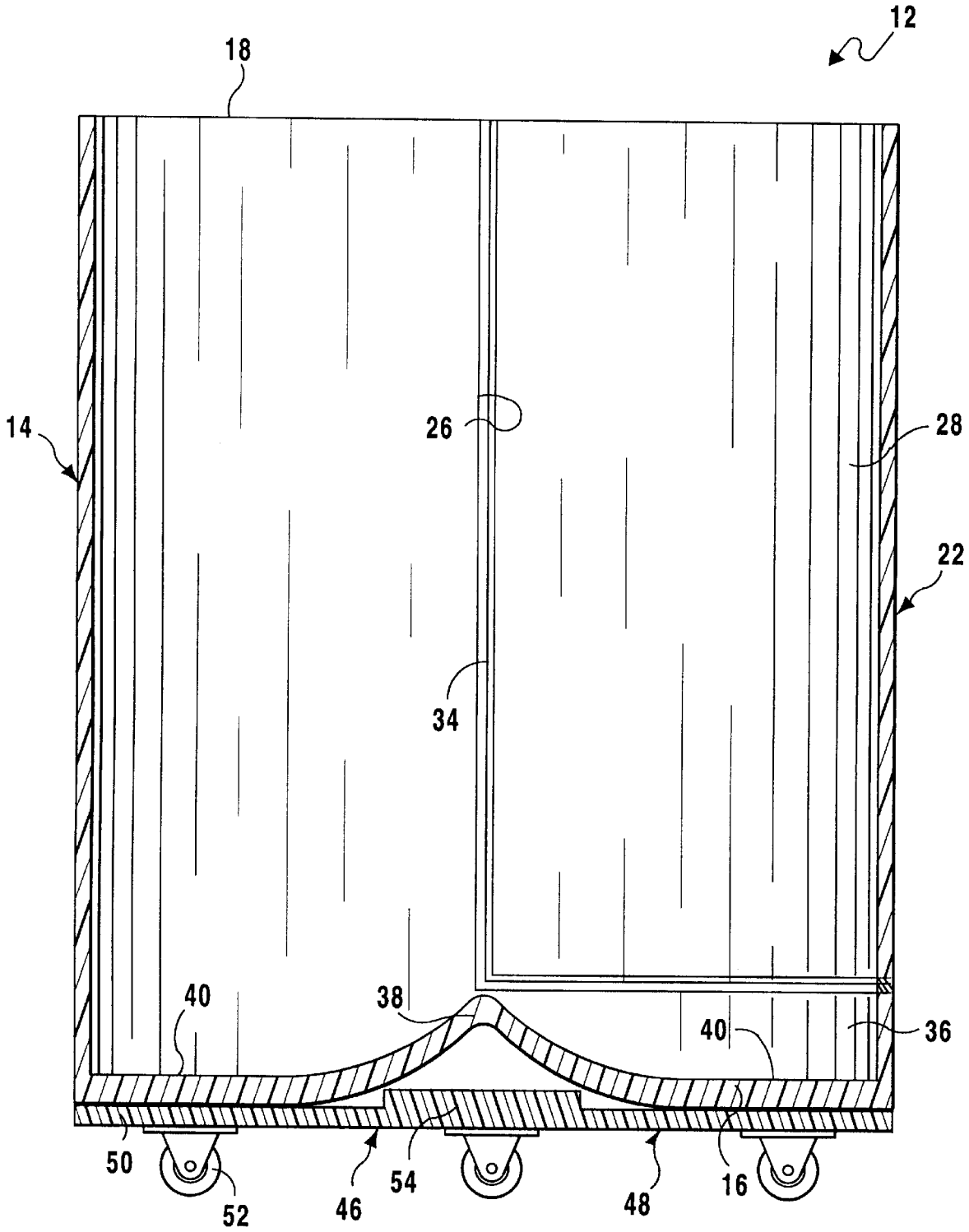
FIG. 8 is a cross sectional view taken along line 8—8 in FIG. 6, with the plastic bag removed therefrom.

An assembly 46 under the base 16 of the housing 14 in FIGS. 6 through 8 is for increasing mobility to the housing 14, especially when the housing 14 is carrying a heavy load. The mobility increasing assembly 46 is a dolly 48, removably positioned on the underside of the base 16 of the housing 14.

Figure 9:
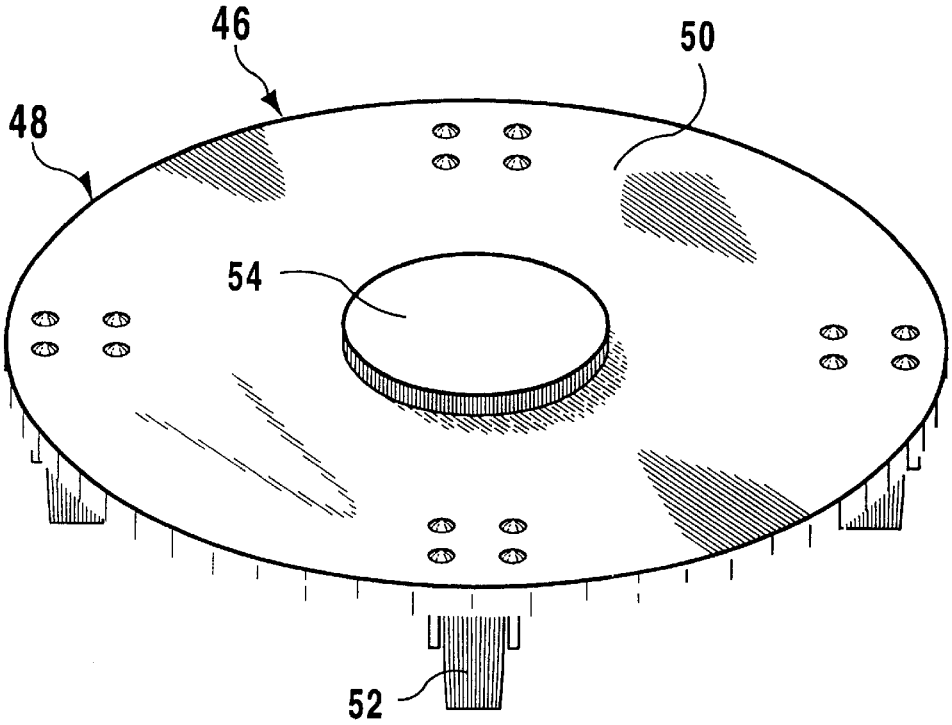
FIG. 9 is a perspective view of a first type of dolly used to transport the second embodiment.
Figure 10:
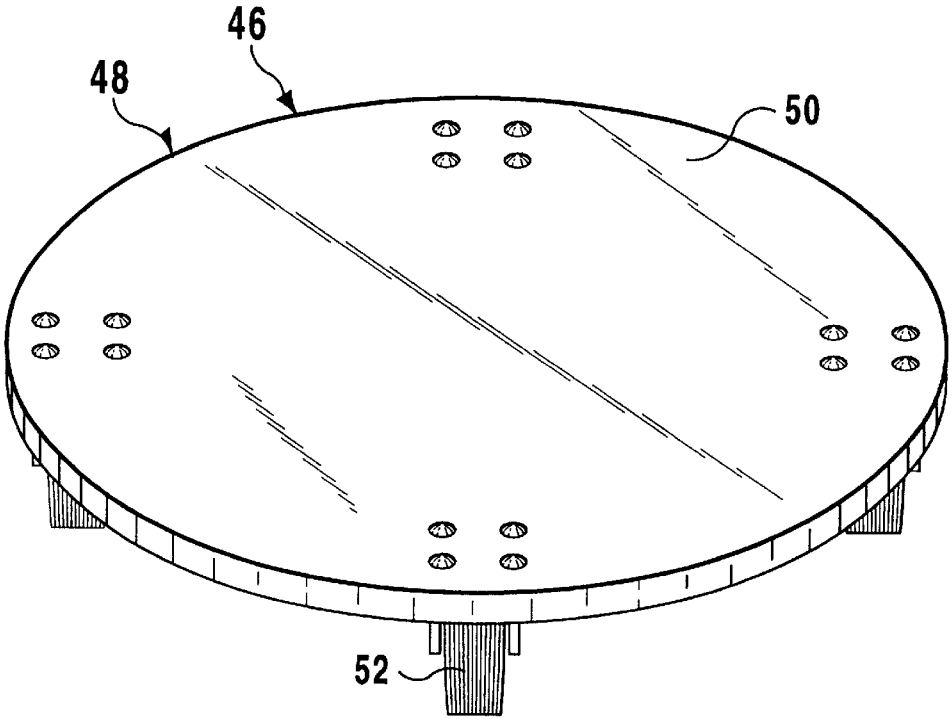
FIG. 10 is a perspective view of a second type of dolly used to transport the second emnbodiment.

The dolly 48, as best shown in FIG. 10, includes a platform 50 and a plurality of casters 52 mounted to the underside of the platform 50. The dolly 48, as best shown in FIG. 9, can contain a centering member 54 on the platform 50, which fits under the raised centered contoured portion 38 of the base 16, so as to properly maintain the dolly 48 thereto.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A trash container comprising:

a) a vertically extending housing being circular in cross section and having a base and an open top end to hold a plastic bag therein, so that articles can be placed within the plastic bag for removal;

b) means in said housing for allowing removal of the plastic bag through a side of said housing instead of lifting the plastic bag out over the open top end;

c) said means in said housing comprising a side opening with vertical side edges extending downwardly from said open top end to a point above said base forming a lip alone the bottom of said opening and a door hinged to one of said vertical side edges of said side opening; and d) said base of said housing having a raised centered contoured portion extending through a middle portion of said base to form a liquid retention sump adjacent said lip.

2. The trash container as recited in claim 1, further including means under said base of said housing for increasing mobility to said housing, especially when said housing is carrying a heavy load.

3. The trash container as recited in claim 2, wherein said mobility increasing means includes a dolly removably positioned on the underside of said base of said housing.

* * * * *